US005921409A

United States Patent [19]

Gerber et al.

[11] Patent Number: 5,921,409

[45] Date of Patent: Jul. 13, 1999

[54] EYE WEAR DISPLAY DEVICE AND METHOD OF USING SAME

[75] Inventors: William J. Gerber, Leucadia; Robert A. Off, Escondido, both of Calif.

[73] Assignee: Delectable Display, Inc., Carlsbad, Calif.

[21] Appl. No.: 08/986,924

[22] Filed: Dec. 8, 1997

[51] Int. Cl.[6] ..... A47F 7/00

[52] U.S. Cl. ..... 211/85.1; 211/205; 248/902

[58] Field of Search ..... 211/13.1, 85.1, 211/205; 248/902

[56] References Cited

U.S. PATENT DOCUMENTS

| | | | |
|---|---|---|---|
| D. 325,935 | 5/1992 | Weiner et al. . | |
| D. 369,039 | 4/1996 | Guccione . | |
| 4,787,520 | 11/1988 | Pearson | 248/902 X |
| 4,890,745 | 1/1990 | Holden . | |
| 5,069,416 | 12/1991 | Ennis . | |
| 5,141,104 | 8/1992 | Morrow et al. . | |
| 5,176,262 | 1/1993 | Zoueki | 248/902 X |
| 5,265,736 | 11/1993 | Orr . | |
| 5,316,252 | 5/1994 | Charnow et al. . | |
| 5,504,541 | 4/1996 | Kolton et al. . | |
| 5,568,872 | 10/1996 | Hinnant, Sr. . | |
| 5,593,045 | 1/1997 | Eldon, III et al. . | |

*Primary Examiner*—Robert W. Gibson, Jr.
*Attorney, Agent, or Firm*—Richard D. Clarke

[57] ABSTRACT

A new and improved V-shaped eye wear display device is provided to enable attractive and effective display of eye wear and eyeglass frames while also allowing multiple and varied configurations and assemblies as required by specific sale promotion and other applications. The novel V-shaped eye wear display device includes two temple free end receiving cavities which support the eyeglass frames by the temple free ends to provide for a more unique, functional, attractive, effective and versatile eye wear display assembly, a more aesthetically pleasing display configuration enabling a clear unobstructed view of the eye wear and frames, a method of using said novel V-shaped equally adaptable to both counter-top and wall mount display assemblies, and to provide an easy to use and configure eye wear display device that is considerably less expensive to manufacture.

20 Claims, 2 Drawing Sheets

EYE WEAR DISPLAY DEVICE AND METHOD OF USING SAME

BACKGROUND OF THE INVENTION

1. Field of the Invention

The present invention relates to an eye wear frame display device and method of using same. More particularly, the present invention relates to a new and improved snap-on eyeglass frame display unit having a unique shape and novel versatile display unit for retaining eye wear by the free ends of the frame's two temple components to effectively and aesthetically display eye wear for selling, and other applications.

2. Description of the Related Art

The use of eyeglass display devices, particularly as employed in retail commercial displays for the purpose of selling such eye wear is well known. An eye wear display unit functions to place eyeglasses in appealing visual setting in order to promote the sale of the eye wear merchandise. Therefore, one function of an eye wear display unit is to show a variety of styles and choices to an interested purchaser, and another function is to initially attract the attention of a potential buyer. In this regard, a clear, unobstructed, uncluttered and aesthetically pleasing eye wear frame display is more effective in achieving these functional objectives.

Eye wear can include eyeglasses, frames without lenses, sample frames with plain glass or plastic lenses, finished eyeglasses, sunglasses, sport glasses, reading glasses, safety glasses and goggles, as well as other types of eye adornment and eye protective equipment.

The standard eyeglasses, or spectacles, are made from a frame component and two lenses. The frame component includes a lens supporting portion, which includes a nosepiece, and two temples, that part of the frame that comes into contact with the side of the head, namely the respective temple and or top portion of the ear of the eyeglass wearer.

There are numerous conventional methods for displaying eye wear. Commonly, eyeglasses are displayed within standard counter display cases, lying on flat surfaces, either with the frame temples folded or open. Another very common display modality is to support the frames by the nosepiece, both in wall display systems and in or on counter display units. Much less common are display systems which support eyeglasses by the temples.

U.S. Pat. Nos. 4,890,745, 5,069,416, 5,141,104, 5,265,736, 5,316,252, 5,504,541, 5,568,872, and 5,593,045 all of wich are incorporated by reference herein, disclose and describe different eyeglass and eye wear frame display fixtures and display systems.

U.S. Pat. No. 4,890,745 teaches three embodiments of an eyeglass holder unit. The first embodiment is a counter-top display device which can accommodate one or more eyeglasses or eye wear frames, all of which are supported by the nosepiece. The second embodiment is a single frame display for counter-top use, and the third embodiment consists of a wall display unit. In all cases the eyeglasses are supported by the nosepiece and the temples can be open or folded. The disadvantages to these display fixtures is that a clear, unobstructed and aesthetically pleasing view of the entire open frame is not possible. Therefore, it would be highly desirable to have a new and improved eye wear display device which is flexible, versatile, displays frames in a clear, unobstructed and aesthetically pleasing fashion, is suitably adapted to both wall mount displays and counter-top displays, is readily inexpensively manufactured and easy to assemble in varying configurations.

U.S. Pat. No. 5,069,416 discloses a unique display fixture for spectacles which enables display in an orientation other than horizontally. Again, the frames are supported by the nosepiece with the temples being either in the open or folded position.

Similarly, U.S. Pat. Nos. 5,316,252 and 5,593,045 describe and claim eyeglass frame display fixtures and systems primarily for wall displays that support the frames by the nosepiece and enable eye wear displaying with the temples open or folded. Again, a clear, unobstructed and aesthetically pleasing view of the frames on display is not possible as a nosepiece supporting element is visible and in close proximity if not in contact with the frames. Therefore, it would be highly desirable to have a new and improved eye wear display device which is flexible, versatile, displays frames in a clear, unobstructed and aesthetically pleasing fashion, is suitably adapted to both wall mount displays and counter-top displays, is readily inexpensively manufactured and easy to assemble in varying configurations.

Another approach taken to attempt to alleviate this problem is to create a card-type hanger for displaying eye wear. U.S. Pat. Nos. 5,141,104 and 5,504,541 disclose and teach such devices. In each, an attempt is made to display the frame by the temples in order to remove the affect of any nosepiece support on the functioning and attractiveness of the display fixture. In both instances the display units are difficult to use, primarily due to the fact that once attached to the display units, eyeglasses and eye wear frames are not readily removed for the customer to try on. Trying on potential frame purchase options, and visualizing oneself in a mirror, is crucial in selling eye wear as most buyers are sensitive to the look of the frames on that individual. Moreover, these units are only suitable for wall mounted display systems and are not easily adapted for counter-top displaying. Therefore, it would be highly desirable to have an eye wear display device in which the frames were supported by the temples only, in an unobstructed aesthetically pleasing and attractive manner, and which facilitated readily removing the frames for trying them on, and placing the frames back on display.

Finally, U.S. Pat. Nos. 5,265,736 and 5,568,872 provide for displaying and holding eyeglasses and eyeglass frames. Neither device is suitable for both wall mounted displays and counter-top displays. For one invention, namely that described in U.S. Pat. No. 5,568,872, the device will only hold eye wear with the temples folded. Furthermore, this unit is only suitable for hanging eyeglasses from a rearview mirror or a counter-top display configuration. With U.S. Pat. No. 5,265,736 the frames are supported by the free ends of the temples. However, this display apparatus is primarily suitable for wall mounted display systems and not easily adapted for counter-top use.

Therefore, it would be highly desirable to have a new and improved eye wear display device which is flexible, versatile, displays frames in a clear, unobstructed and aesthetically pleasing fashion, is suitably adapted to both wall mount displays and counter-top displays, is readily inexpensively manufactured and easy to assemble in varying configurations.

SUMMARY OF THE INVENTION

Therefore, the principal object of the present invention is to provide a new and improved eye wear display device and method of using same that facilitates a clear, unobstructed, aesthetically pleasing and attractive view of eye wear and eye wear frames.

It is a further object of the present invention to provide such a new and improved eye wear display method that incorporates a unique eye wear frame display device that is readily adaptable to both table-top, counter-top and wall mounted or vertical surface mounted display configurations and applications.

It is yet a further object of the present invention to provide such a new and improved eye wear display device and method of using same in which customized combinations are readily and easily configured and assembled, as required by varying applications.

It is yet another object of the present invention to provide such a new and improved eye wear display device which is easy to use and less expensive to manufacture, yet attractive and effective in promoting eye wear frame sales and other associated applications.

Briefly, the above and further objects of the present invention are realized by providing a new and improved V-shaped eye wear display device to enable attractive and effective display of eye wear and eyeglass frames while also allowing multiple and varied configurations and assemblies as required by specific sale promotion and other applications. The novel V-shaped eye wear display device includes two temple free end receiving cavities which support the eyeglass frames by the temple free ends to provide for a more unique, functional, attractive effective and versatile eye wear display assembly, a more aesthetically pleasing display configuration enabling a clear unobstructed view of the eye wear and frames, a method of using said novel V-shaped equally adaptable to both counter-top and wall mount display assemblies, and to provide an easy to use and configure eye wear display device that is considerably less expensive to manufacture.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

DESCRIPTION OF THE PREFERRED EMBODIMENTS

Figure 1:
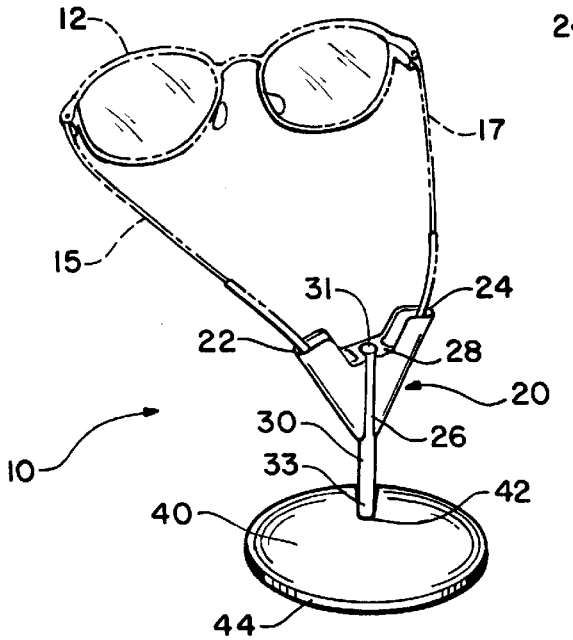
FIG. 1 is a perspective view of the novel eye wear display device attached to a rod element and supported by a simple base assembly, indicating the position of eye wear frames as displayed thereon.
Figure 2:
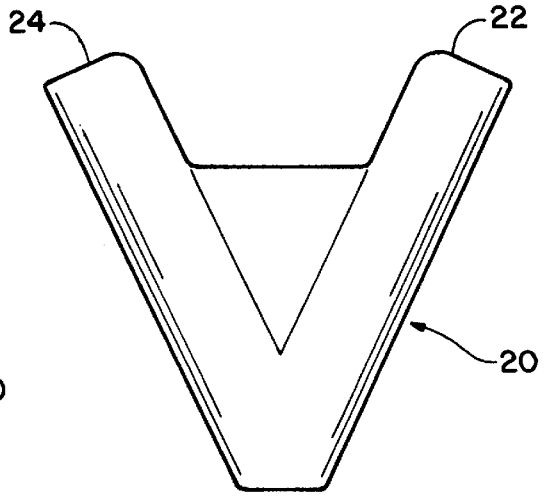
FIG. 2 is a front elevational view of the novel eye wear display device.
Figure 3:
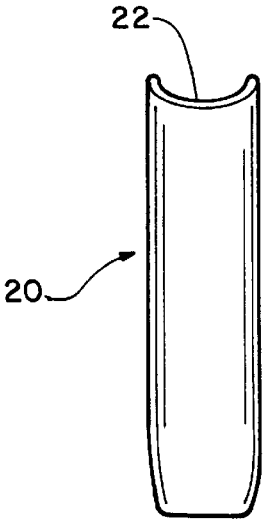
FIG. 3 is a side elevational view of the novel eye wear display device.
Figure 4:
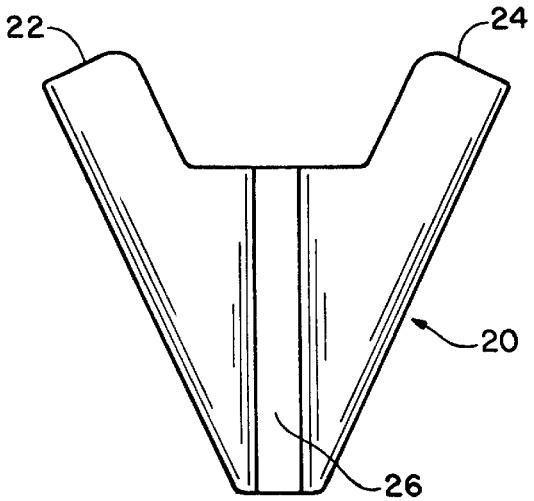
FIG. 4 is a rear elevational view of the novel eye wear display device.
Figure 5:
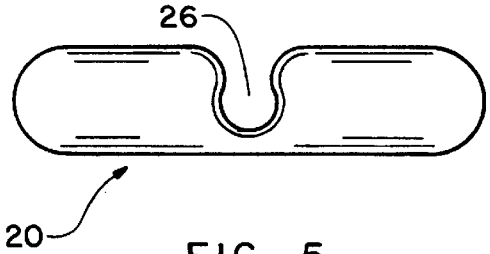
FIG. 5 is a bottom view of the novel eye wear display device.
Figure 6:
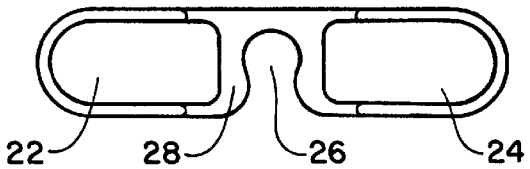
FIG. 6 is a top plan view of the novel eye wear display device.

Referring now to the drawings, and more particularly to FIG. 1 thereof, there is shown a new eye wear display assembly 10 incorporating the novel V-shaped eye wear display unit 20 which is constructed in accordance with the present invention. The new eye wear display device 10 is used to efficiently and effectively display eyeglasses and eye wear frames 12 in an aesthetically pleasing fashion. The V-shaped eye wear display unit 20 supports the eyeglass frames 12 by receiving the free ends of the frame temple components 15 and 17 into temple receiving cavity 22 and 24, respectively. In this way, the frames are seemingly suspended in air, free of view obstructions, especially with regard to the nosepiece portion of the frames.

The novel display device assembly 10 is constructed of three primary components. The first being the V-shaped display unit 20, which includes the temple receiving cavities 22 and 24, a rod receiving channel 26 and an upper surface 28. The other two components of the novel display assembly include the support rod 30 having an upper portion 31 and a lower portion 33, and the base 40 having a rod receiving aperture 42 and a lower portion 44 which would come into contact with the horizontal surface of a table, counter-top, or the like.

Referring now to FIG. 1 in greater detail, the components making up the eyeglass and eye wear frame display assembly 20 are simply and readily assembled. The eye wear display device 20 is easily attached to any support rod, such as support rod 30 having the appropriate diameter. The display device 20 snaps into place by the insertion of the upper portion 31 of support rod 30 into the support rod receiving channel 26 integrally molded into the display device 20. Support rod 30 is then secured to a base means, such as base 40, by insertion of the lower portion of the support rod 33 into a support rod receiving aperture 42 located on the upper surface of base 40.

When in use to display eyeglasses and eyeglass frames, display device assembly 10 is placed on a table top or counter-top, or the surface of any horizontal plane on which the display assembly is to be located. The lower portion 44 of base 40 can be any stable shape (a circular embodiment is shown). Additionally, the base 40 can be weighted to improve stability and lessen the likelihood that the display assembly 20 will be tipped over. The two temple components 15 and 17 of the eyeglass frames 12 are then inserted into the temple receiving cavities 22 and 24 respectfully. The result is that the eyeglasses or eye wear frames are simply and elegantly displayed. The display is both aesthetically pleasing and easy to use, as there is no obstruction to viewing the frames 12 from any angle, and the frames 12 are readily removed from and replaced back onto the display assembly 10. In this way, the novel display device 20 and method of use facilitates a unique, simple, functional, attractive and inexpensive alternative to eye wear and eye wear frame displaying for sale and other applications.

Also, the novel V-shaped display device 20 is a very versatile display component. Whereas FIG. 1 demonstrates a relatively simple display design alternative using the novel V-shaped eye wear display device 20, it should be understood that there are numerous other possible configurations of aesthetically pleasing, unique and simple applications of the display device 20 in attractively and effectively displaying eye wear and eye wear frames.

Considering now the novel V-shaped eye wear display device 20 in greater detail with reference to FIGS. 2, 3, 4, 5 and 6, the V-shaped eye wear display device 20 includes two temple receiving cavities 22 and 24, an upper surface 28 and a support rod receiving channel 26. The display device 20 may be constructed of any suitable material including, but not limited to, plastic, metal, wood, and any natural or synthetic substance alone or in combination. The preferred mode of manufacturing the display device 20 is to construct it by molding using plastics and other suitable molding materials.

The V-shaped display device 20 attaches to any appropriately sized support rod by being snapped into place on the support rod. When attached to a support rod, display device 20 frictionally engages the support rod within the support rod receiving channel 26. The snug fit between the support rod and support rod receiving channel 26 sets and holds the position of the V-shaped display device at any location on the support rod. One or more novel V-shaped display devices can be attached to one or more support rods in this way. The support rod or rods may be constructed of any suitable material including, but not limited to, plastic, metal, wood, and any natural or synthetic substance alone or in combination. The bases may consist of existing stable flat planes or surfaces or be constructed of any suitable materials, including but not limited to plastic, metal, wood, rock, glass, and any other natural or synthetic material alone or in combination.

Additionally, the novel V-shaped display device 20 can be configured to be attached to both support rods and flat surfaces, such as wall display units, by using other suitable attachment means. For example, hook and loop material, such as VELCRO™, can be affixed to the display device and the flat or other surface to which the display device is to be attached. One or more novel V-shaped display devices can be affixed to a flat or other surface in this way. Furthermore, the novel V-shaped eyeglass and eye wear frame display device can be affixed to a flat surface using more conventional means, such as by being held nails, held by screws, glued, by magnetic attraction, and by many other conventional methods of attachment. Numerous matrices and arrays of the novel V-shaped display device can be configured in this manner.

Figure 7:
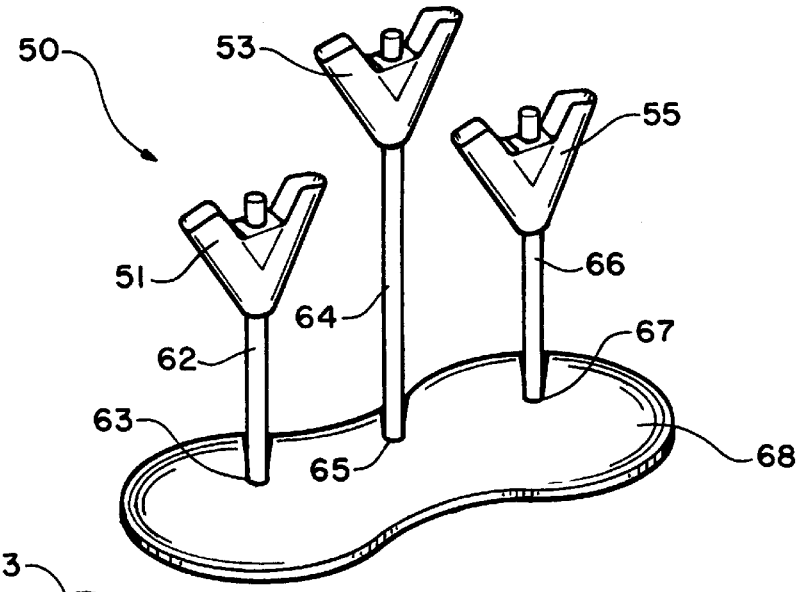
FIG. 7 is a perspective view of a typical embodiment of a counter-top display assembly integrating three of the novel eye wear display device units.
Figure 8:
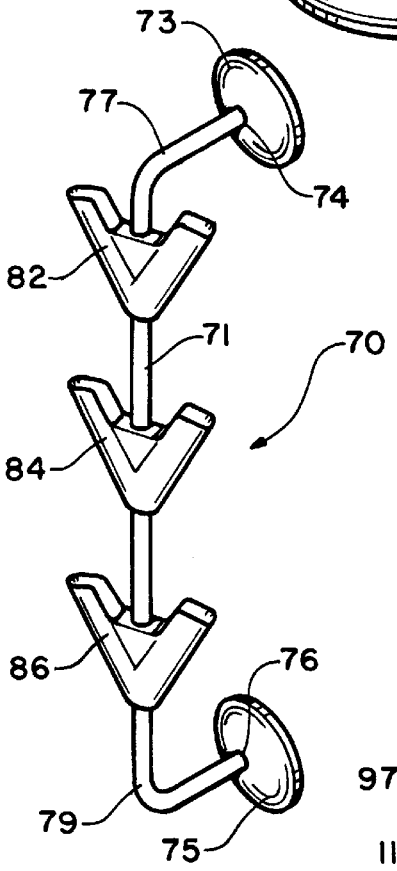
FIG. 8 is a perspective view of a another typical embodiment of a wall mount display assembly integrating three of the novel eye wear display device units.
Figure 9:
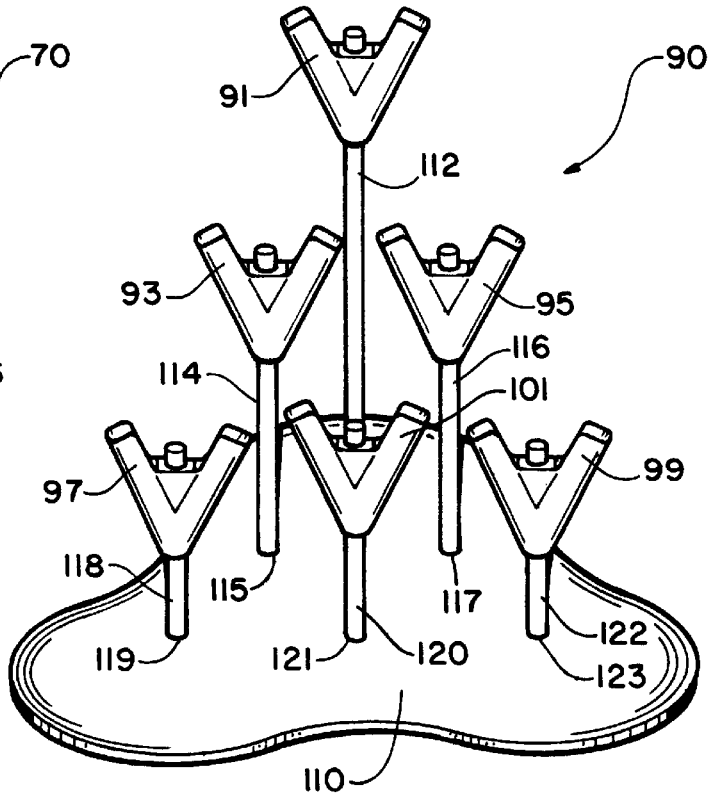
FIG. 9 is a perspective view of a typical embodiment of a counter-top display assembly integrating six of the novel eye wear display device units.

Turning now to FIGS.7–9, the versatility of configuring the novel V-shaped display device 20 is demonstrated in three unique embodiments constructed in accordance with the present invention.

Considering now the display assembly 50 in greater detail with reference to FIG. 7, the display assembly 50 consists of a base 68 having three support rod receiving apertures 63, 65 and 67 spaced at regular intervals on its upper surface. Inserted into these support rod receiving apertures 63, 65 and 67 are three support rods 62, 64 and 66 respectively. Snapped into place at the upper portion of each of the support rods 62, 64 and 66 are the novel V-shaped eye wear display devices 51, 53 and 55 respectively. Support rods 62, 64 and 66 can be of differing heights to highlight and accent the eyeglasses and eye wear frames to be displayed thereon. Moreover, the novel V-shaped display devices 51, 53 and 55 can be set at varying radial angels to one another to allow a full, three-dimensional aesthetically pleasing and attractive display of frames for sale or some other application. The required base 68 made be of any size and shape to confer stability to the display assembly 50. Additionally, appropriately sized holes may be bored into any stable flat surface to accommodate the support rods. In operation, eyeglasses and eye wear frames are easily and quickly inserted into and removed from the V-shaped display devices 51, 53 and 55.

Considering now the display assembly 70 in greater detail with reference to FIG. 8, this embodiment of a display assembly configuration is but one of many possible wall or vertical surface mount display assembly embodiments. A support rod 71 is mounted onto any vertical surface, such as a wall or display board via two mounting base means 73 and 75. The wall mounting base means may have support rod apertures such as support rod apertures 74 and 76 in which is received the end portions of the support rod 71. Similarly, any vertical surface may contain like apertures to accept one or more support rods. A right angle bend 77 in the upper portion of the support rod 71, and a right angle bend 79 in the lower portion of the support rod 71 create a vertical support rod orientation. Novel V-shaped display devices 82, 84 and 86, and more in number when desired, can then be readily snapped or affixed onto the support rod. In this way, the V-shaped display devices are set and held at the correct position to accept the two temple free ends of any eye wear or eye wear frames to be displayed. Again, the radial angles of the V-shaped display devices 82, 84 and 86 can be adjusted to provide for the most aesthetically pleasing and attractive display. In operation, eyeglasses and eye wear frames are easily and quickly inserted into and removed from the V-shaped display devices 82, 84 and 86.

Considering now the display assembly 90 in greater detail with reference to FIG. 9, the display assembly 90 consists of a larger base 110 having six support rod receiving apertures 115, 117, 119 121, 123 and one not shown, spaced at regular intervals on its upper surface. Inserted into these support rod receiving apertures 115, 117, 119, 121, 123 and one not shown are six support rods 114, 116, 118, 120, 122 and 112, respectively. Snapped into place at the upper portion of each of the support rods 112, 114, 116, 118, 120 and 122 are the novel V-shaped eye wear display devices 91, 93, 95, 97, 101 and 99, respectively. Support rods 112, 114, 116, 118, 120 and 122 can be of differing heights to highlight and accent the eyeglasses and eye wear frames to be displayed thereon. Moreover, the novel V-shaped display devices 91, 93, 95, 97, 99 and 101 can be set at varying radial angels to one another to allow a full, three-dimensional aesthetically pleasing and attractive display of frames for sale or some other application. The required base 110 made be of any size and shape to confer stability to the display assembly 90. Additionally, appropriately sized holes may be bored into any stable flat surface to accommodate the support rods. In operation, eyeglasses and eye wear frames are easily and quickly inserted into and removed from the V-shaped display devices 91, 93, 95, 97, 99 and 101.

By employing the novel V-shaped eye wear display device in the four disclosed, or any other of the numerous creative possible configurations, eye wear can be effectively and efficiently displayed in a unique, simple, aesthetically pleasing, attractive and functional fashion, and much more inexpensively than with most other conventional display methods.

It should be understood, however, that even though these numerous characteristics and advantages of the invention have been set forth in the foregoing description, together with details of the structure and function of the invention, the disclosure is illustrative only, and changes may be made in detail, especially in matters of shape, size, and arrangement of parts within the principal of the invention to the full extent indicated by the broad general meaning of the terms in which the appended claims are expressed.

What is claimed is:

1. An eye wear display device, comprising:

(a) holding means for receiving and supporting eyeglass frames by the free ends of the temple pieces, whereby said holding means includes a V-shaped member having two frame temple piece receiving hollow cavities integrally formed into the top portion of said V-shaped member;

(b) support means for accepting and supporting said holding means;

(c) attachment means for securing one or more of said holding means to said support means; and (d) base means for accepting and securing one or more of said support means.

2. An eye wear display device according to claim 1, wherein said holding means which includes a V-shaped member having two frame temple piece receiving hollow cavities integrally formed into the top portion of said V-shaped member and said attachment means for securing one or more of said holding means to said support means is integrally formed into said V-shaped member, are together incorporated into an integrated unitary part.

3. An eye wear display device according to claim 1, wherein said attachment means includes a support means receiving hollow channel integrally formed into said holding means.

4. An eye wear display device according to claim 1, wherein said support means includes an elongated cylindrical member.

5. An eye wear display device according to claim 4, wherein said support means includes a rod.

6. An eye wear display device according to claim 1, wherein said base means includes one or more apertures for accepting said support means.

7. An eye wear display device comprising:

(a) holding means for receiving and supporting eyeglass frames by the free ends of the temple pieces, whereby said holding means includes a V-shaped member having two frame temple piece receiving hollow cavities integrally formed into the top portion of said V-shaped member;

(b) support means for accepting and supporting said holding means;

(c) attachment means for securing one or more of said holding means to said support means; and (d) base means for accepting and securing one or more of said support means; wherein said holding means is constructed of one single molded plastic unit.

8. An eye wear display device according to claim 1, wherein several of said holding means is attached to several of said supporting means by several of said attachment means, and said several support means are secured by one base means, whereby several eye wear frames can be displayed simultaneously.

9. An eye wear display device according to claim 8, wherein said several support means are of varying lengths, whereby the eye wear frames are displayed at varying heights.

10. An eye wear display device according to claim 1, wherein said several of said holding means are attached to a single of said support means, whereby several eye wear frames are displayed using a single support means.

11. A method of using an eye wear display device comprising the steps:

(a) providing a V-shaped eye wear frame holding means having two hollow temple piece receiving cavities to support the eye wear frames by the free ends of the temple pieces;

(b) providing a support means for accepting and supporting said holding means;

(c) providing an attachment means for securing one or more of said holding means to said support means; and (d) providing a base means for accepting and securing one or more of said support means whereby said holding means supports eye wear frames by the free ends of the temple pieces, said attachment means secures said holding means to said support means, and said support means are accepted and secured by said base means, allowing the display of eye wear.

12. A method of using an eye wear display device according to claim 11, wherein the step of providing a V-shaped eye wear fram holding means having two hollow temple piece receiving cavities to support the eye wear frames by the free ends of the temple pieces, includes providing said holding means constructed of molded plastic.

13. A method of using an eye wear display device according to claim 11, wherein the step of providing a support means for accepting and supporting said holding means includes providing an elongated cylindrical member.

14. A method of using an eye wear display device according to claim 11, wherein the step of providing an attachment means for securing one or more of said holding means to said support means includes providing a support means receiving channel integrally formed into said holding means.

15. A method of using an eye wear display device according to claim 11, wherein the step of providing a base means includes providing a base means with one or more apertures for securing and holding said support means.

16. A method of using an eye wear display device according to claim 15, wherein the step of providing a base means includes providing a vertical planar base means with one or more apertures for securing and holding said support means, whereby eye wear are displayed on a wall mounted vertical surface.

17. A method of using an eye wear display device according to claim 16, wherein the step of providing a base means includes providing a vertical planar base means with one or more holding means attached to said base means by said attachment means for securing and holding said holding means, whereby one or more eye wear frames are displayed on a wall mounted vertical surface.

18. A method of using an eye wear display device according to claim 17, wherein said attachment means includes hook and loop material.

19. A method of using an eye wear display device according to claim 17, wherein said attachment means includes adhesive glue.

20. A method of using an eye wear display device according to claim 17, wherein said attachment means includes screws.

* * * * *